United States Patent [19]

Schwalenstocker et al.

[11] 4,017,056

[45] Apr. 12, 1977

[54] SERVO CONTROL SYSTEM FOR ELECTRO-HYDRAULIC INLET VALVES

[75] Inventors: Thomas H. Schwalenstocker, Indiana Township, Glenshaw; William E. Zitelli, Middletown Township, Media both of Pa.

[73] Assignee: Westinghouse Electric Corporation, Pittsburgh, Pa.

[22] Filed: Feb. 23, 1976

[21] Appl. No.: 660,747

[52] U.S. Cl. ..... 251/131; 91/363 R

[51] Int. Cl.[2] ..... F16K 31/02

[58] Field of Search ..... 251/131; 91/363 R

[56] References Cited

UNITED STATES PATENTS 3,015,768 1/1962 Hornfelk et al. ..... 91/363 R

*Primary Examiner*—Arnold Rosenthal
*Attorney, Agent, or Firm*—H. W. Patterson

[57] ABSTRACT

A position control system that interfaces turbine control systems with an electro-hydraulic actuator for inlet valves, is disclosed. The system includes a feedback signal generating means that eliminates the effect of differences in ground potentials which would otherwise cause undesirable valve movement and also a proportional plus integral controller that has independent porportionality and reset parameter adjustment. The system also includes a position characterizer that generates independent line segments in the feedback loop, and which provides for selecting monotonically decreasing slopes, or slopes with inflection discontinuities.

10 Claims, 10 Drawing Figures

SERVO CONTROL SYSTEM FOR ELECTRO-HYDRAULIC INLET VALVES

BACKGROUND OF THE INVENTION

1. Field of the Invention

The present invention relates to a position control system for electro-hydraulically operated turbine inlet valves.

2. Description of the Prior Art

The inlet valves, which control the admission of fluid under pressure to operate the turbine of an electric power plant, typically, are positioned by an hydraulic valve actuator. The hydraulic valve actuator is controlled by a servo valve that admits hydraulic fluid under pressure to the actuator in accordance with the value of an electrical signal generated by a turbine control system. Mechanically coupled to the actuator is a linear variable differential transformer (LVDT) that generates through a demodulator an electrical feedback signal coresponding to the actual position of the inlet valve. This feedback signal is summed or compared with the valve control electrical signal to insure that the inlet valve or valves are operated to the exact position required by the turbine control system.

The signal from the turbine control system is typically an analog DC signal that varies from 0 to +10 volts, for example, with the minimum voltage requiring a fully closed valve position; and the maximum voltage requiring a fully open valve position. The feedback signal at the output of the demodulator is also an analog DC signal generated by the LVDT that varies from 0 to +10 volts, for example, with the minimum voltage representing an actual closed position of the valve, and the maximum value representing an actual fully open position of the valve. The system includes a porportional plus integral controller that responds to an error signal that is caused by a change either in the control signal or the feedback signal to change its output signal for moving the valve until the demodulated LVDT signal when summed with the control signal results in an effective no error signal to the input of the controller.

Prior to the present invention, such valve positioning control systems, included ground connections, which could at times cause a difference in ground potential that would result in undesirable valve movement, particularly in an enrivonment where there was a substantial prevalence of electrical noise. Also, such systems included a proportional plus integral controller that was so constituted that an adjustment of the system resulted in the adjustment of both the proportional and the integral or reset parameters. Thus, it was difficult to adjust the system such that a relatively large error signal did not cause overshooting of valve position without an accompanying delay in the valve moving to the desired position. Further, in operating the valves from a fully open to a fully closed position, a delayed response due to the saturation of the system servo amplifier could occur.

Inlet valves, such as steam inlet valves for turbine power plants, have non-linear position versus flow characteristics, (i.e., for example, a 20 to 30% valve position may provide an 80% steam flow); and this nonlinearity may vary in accordance with the type of valve and with the upstream and downstream pressures at which the system operates. It is desirable in turbine control systems to operate the valves in accordance with the desired steam flow through the valves instead of a desired valve position. Depending on the type of control system, this is accomplished by either characterizing the input or control signal, or by characterizing the position feedback signal from the LVDT in accordance with the predetermined curve of steam flow versus valve lift position. For those systems that characterize the input or control signal, the feedback signal is linear; (that is, a 60% input or control signal requires a 60% valve position, for example). However, in those systems that characterize the feedback position signal, the input signal is not characterized; (i.e., for example, an 80% flow or input signal may move the valve to only a 30% open position). This characterization of feedback position is accomplished, typically, by a function generator or position characterizer that generates a predetermined output signal in response to a particular input signal from the LVDT. The characterization is affected by one or more line segments, i.e., an output signal is a certain linear function of the input signal over one range of input values, and then at a break point value, the output signal becomes another linear function of the input signal. Thus, the curve of flow versus position can be approximated by the line segments. It is evident, therefore, tht the more line segments involved in the characterization, the greater the accuracy or approximation of the curve.

However, because of the inherent drift characteristics of the electronic components of the system, it was desirable to minimize the number of line segments utilized for curve approximation. Each one of the line segments would be dependent on the adjacent one, i.e., if one line segment should drift, the break point of the next line segment would be at a different point and such error would be multiplied. With a number of line segments, this drift could cause the resulting curve to be quite dissimilar to the desired flow versus position characterization. Also, such drift could cause the valve position to be satisfied by more than one point on adjacent line segments. Also, in such systems it is difficult to calibrate the valve control system to provide for the desired curve relationship.

In view of the above, it is desirable to provide an improved valve position servo system, the operation of which does not cause undesirable valve movement. One way of accomplishing this result is by signal conditioning the input and feedback signals with differential amplifiers to provide a high common mode noise rejection and common mode voltage range. Also, to provide for more accurate and versatile valve control, it is desirable that such a system provide for independent adjustment of the following and converging errors of the proportional plus integral controller. Further, such a system should insure fast valve response at all times, even from a fully open to a fully closed position. This may be accomplished by preventing the systems servo amplifier from saturating while in a fully open position.

It is further desirable, that such a servo control system may be used with turbine control systems that require both linear and position characterization feedback; and for control systems requiring position characterization feedback, such a system should be capable of utilizing a number of line segments for more accurate representation of the valve position versus flow curve without the multiplying effects of drift. Also, such a system should be versatile and useful for various types of valves requiring different characterization curves, and which are readily adjustable for particular applications.

SUMMARY OF THE INVENTION

A system for controlling the position of an electrohydraulically operated valve wherein a valve actuator positions the valve in accordance with the valve of an electric valve position signal; and a feedback loop generates a feedback signal corresponding to the inductive coupling of a linear variable differential transformer (LVDT) corresponding to the position of the valve. In one aspect, a pair of differential buffers are connected across secondary windings of the LVDT and positive half wave rectifiers are connected across the buffers to rectify the current in the secondary windings. The outputs of the buffers and the rectifiers are summed algebraically to characterize the feedback signal in the form of a DC voltage having a level corresponding to the position of the valve.

In another aspect, the system includes a function generator to characterize, according to a predetermined curve of a plurality of linear slopes, one of the signals at the controller input to vary the valve position signal as a non-linear function of the one signal. The function generator is so constituted that each of the slopes are independent of the other.

In still another aspect, the system includes a proportional plus integral controller that is so constituted that the proportionality and the time constant are adjustable independent of the other.

In still another aspect, the system includes means to prevent saturation of the controller when the valve actuator is at a limit position.

DESCRIPTION OF THE PREFERRED EMBODIMENT

Figure 1:
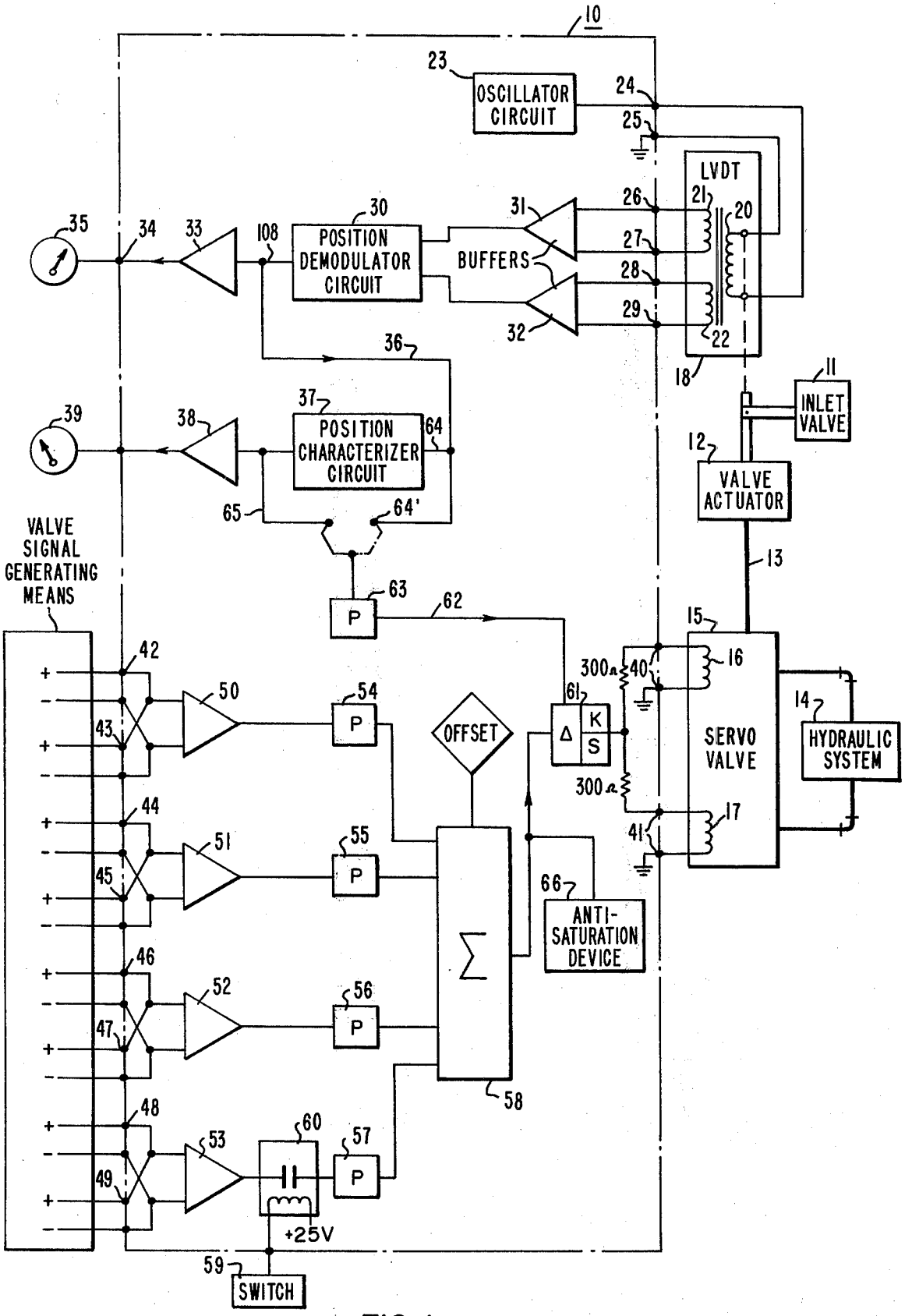
FIG. 1 is a schematic block diagram of a servo control system connected to control an electrohydraulically operated valve in accordance with one embodiment of the present invention.

Referring to FIG. 1, the control system 10, the components of which are included within the dashed lines, is preferably in the form of a printed circuitboard having suitable input and output terminals. The system 10 controls the operation or position of an inlet valve 11, which may be any conventional valve, such as a throttle valve or governor valve of a steam turbine installation. The valve 11 is operated by a valve actuator 12, which in turn is controlled by the admission of hydraulic fluid through lines 13 connected to a conventional hydraulic system 14 and a servo valve mechanism 15. The servo valve may be a conventional, well known MOOG valve that controls the position and rate of travel of the valve actuator 12. The servo valve is operated electrically in accordance with the MOOG valve coils 16 and 17 in a well known manner in accordance with the value of a DC voltage across such coils. The valve actuator is suitably connected in a well known manner to a linear variable differential transformer (LVDT) referred to at 18. The LVDT 18 has a primary winding 20 and secondary windings 21 and 22. A coupling (not shown) between the primary and secondary winding moves in accordance with the position of the valve actuator to produce a feedback signal corresponding to the position of the coupling relative to the primary winding 20 and the secondary windings 21 and 22.

The servo system 10 which is on a single printed circuit card according to one actual embodiment of the invention, has a number of input and output terminals that interface with a turbine control system and with the servo valve mechanism 15 and the LVDT 18 as previously described. For example, an oscillator 23 which may be a conventional oscillator having a frequency of 1 kilohertz for example energizes the primary winding 20 of the LVDT 18 by way of output connections 24 and 25. The system 10 inputs 26 and 27, which are connected to the LVDT secondary winding 21, and input terminals 28 and 29, which are connected to the secondary winding 22, provide the input to a position demodulator 30 through buffers 31 and 32. The voltage in the secondary 21 increases as the actuator position changes to open the valve and the secondary 22 voltage decreases as the actuator position increases the valve opening. The buffers or amplifiers 31 and 32 are used to enhance the noise rejection of the system. Each secondary winding 21 and 22 is connected differentially independent of any ground; thus, the system is completely floating with respect to the position input from the LVDT and the differential voltage across the LVDT secondary winding is measured by the amplifiers 31 and 32. The position demodulator 30 is merely rectifying, adding and filtering the signals from the buffers 31 and 32 in a well known manner. A buffer 33 merely buffers the position signal from the demodulator 30 and is connected to a terminal such as 34 for operating a meter 35, for example, or any other circuits that may need the actual position signal of the inlet valve 11. The output of the position demodulator 30 is also connected by a line 36 to a position characterizer 37, and a buffer 38 to drive a suitable meter 39 indicating the characterized position of the valve or a suitable external circuit.

Outputs 40 and 41 connected to the windings 16 and 17 of the MOOG valve determine the valve spool position which in turn controls the rate and direction of travel of the valve actuator 12 as previously mentioned. The coils 16 and 17 are so connected that current flowing into the outputs 40 and 41 causes the actuator position 12 to increase to open the valves; and current flowing out of the inputs 40 and 41 causes the position of the actuator 12 to decrease toward a closed valve position. The input signal to control the position of the valve is applied to eight differential inputs referred to at 42, 43, 44, 45, 46, 47, 48, and 49 which are arranged in four pairs. Each pair of the differential inputs is connected to an input buffer 50, 51, 52, and 53, respectively. Each one of the input buffers 50–53, is a differential amplifier that serves to enhance the noise rejection of the system due to improper grounding, for example. Normalizing circuits referred to at 54, 55, 56, and 57 provide the common denominator to a summing junction 58. The normalizing function serves to normalize each of the input signals to range from zero to ten volts, for example. A switch 59 which may be system logic output controls a normally open relay 60 to either connect or disconnect the output of the input buffer 53 to the summing junction 58. The summing junction 58 averages the voltages from the normalizing circuits 54 through 57 for input to a proportional plus integral controller 61. Also, an input from either the position demodulator 30 without characterization is applied to the controller 61 over line 62 after being normalized at 63 when a jumper connection 64 bypasses the position characterizer 37. When the jumper connection 64 is connected to output 65 of the position characterizer 37, the input 62 to the controller 61 provides a nonlinear response as will be described in detail hereinafter. An antisaturation device referred to generally at 66 prevents the controller from becoming saturated when the actuator 12 is at the limit of its increased or decreased position. An offset 67 provides an input voltage that just starts to open the valve when the input voltage to the summing junction 58 is at zero.

Figure 2:
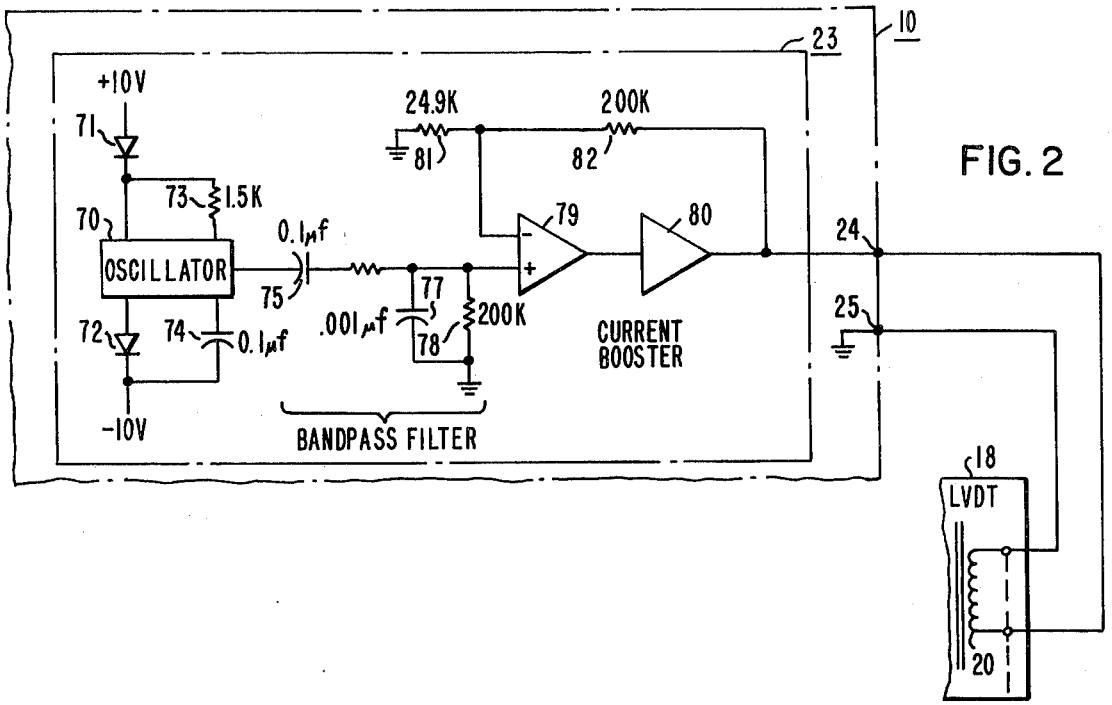
FIG. 2 is a schematic diagram of the oscillator portion of the system shown in FIG. 1.

Referring to FIG. 2, the oscillator circuit generally referred to as 23 includes a conventional standard sinewave oscillator function generator 70 which is driven from a +10 volt and −10 volt reference source through diodes 71 and 72 which provide compensation for temperature deviations. A resistor 73 together with a capacitor 74 determines the frequency of the oscillator. In one actual embodiment, the frequency of the oscillator 70 is 1 kilohertz. A filter circuit that includes a capacitor 75 in series with a resistor 76 coupled to parallel connected capacitor 77 and resistor 78 filters any DC current and high frequency current or harmonics that might form at the output of the oscillator 70. An amplifier 79 is connected at the output of the filtering circuit to provide a voltage gain and buffer the output signal of the oscillator. It provides a high impedance load to the filter sinewave output. A current booster 80 is connected to the outputs of the amplifier or buffer 79 to provide the required drive currents for the primary 20 of the LVDT. Resistors 81 and 82 determine the gain of the circuit.

Figure 3:
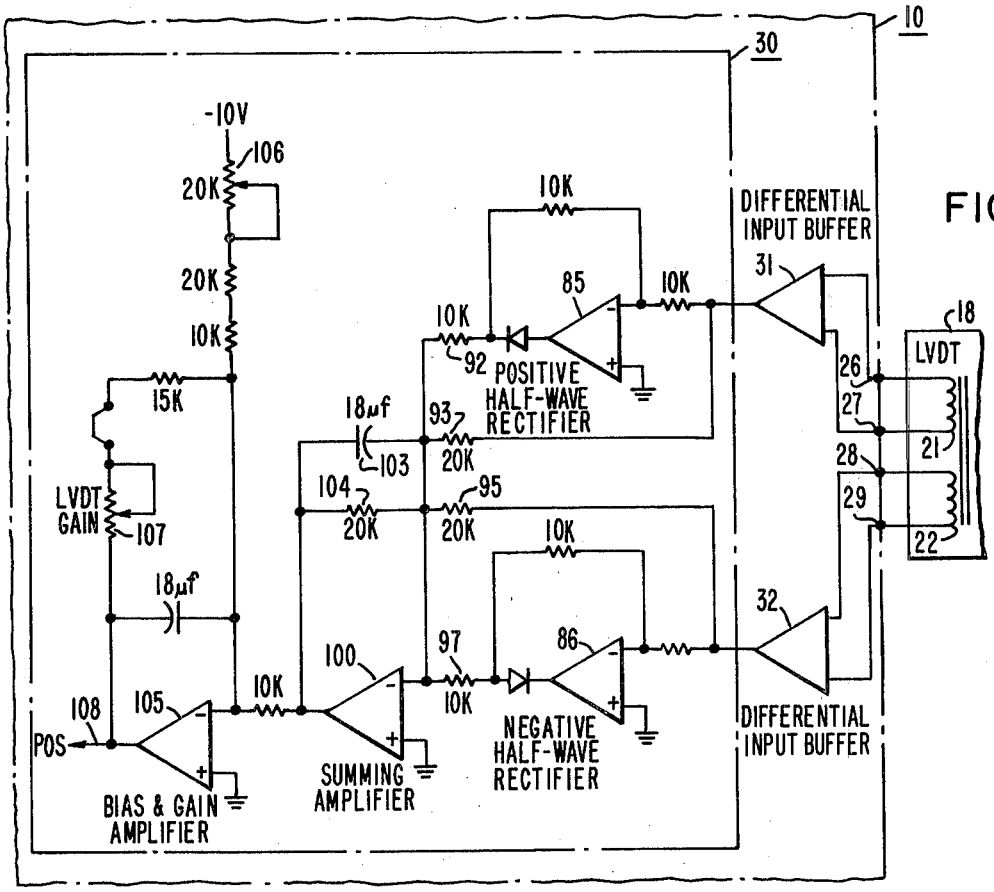
FIG. 3 is a schematic diagram of the position demodulator shown in FIG. 1.
Figure 4:
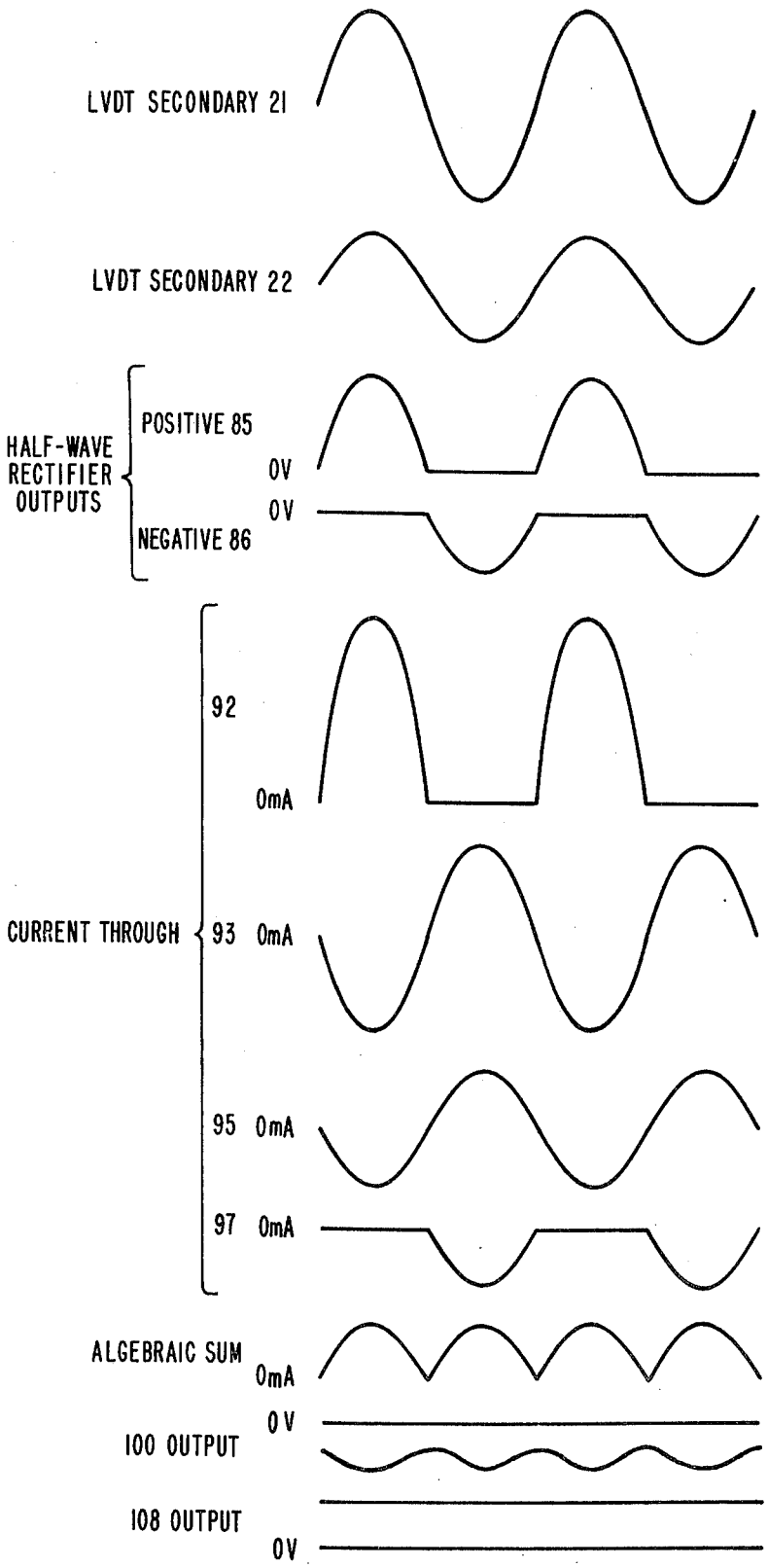
FIG. 4 is a graphical illustration of the waveforms associated with the position demodulator of FIG. 3.

Referring to FIG. 3, the secondary windings 21 and 22 of the LVDT are connected through terminals 26, 27 and 28, 29 to the differential input buffers 33 and 34. The position demodulator circuit within the dashed lines referred to at 30 includes a positive halfwave rectifier 85 driven by the input buffer 33 and a negative halfwave rectifier 86 driven by the input buffer 34. As previously mentioned, the voltage in the secondary 21 increases as the position of the actuator increases towards an open valve position; and the voltage in the secondary winding 22 decreases as the actuator position increases towards the open valve position. With reference to FIG. 4, waveform 87 illustrates a sinewave output for the secondary winding 21, and waveform 88 illustrates a waveform of lesser amplitude, for example, at the output of the secondary winding 22. In response to the waveforms 87 and 88, the halfwave rectifier 85 generates a waveform 89, and the halfwave rectifier 86 generates a waveform 90.

At the output of the positive halfwave rectifier 85, a current waveform 91 occurs at the output of a resistor 92. At the output of a resistor 93 which bypasses the rectifier 85 a current waveform 94 is generated as shown in FIG. 4. Similarly, a current waveform at resistor 95 is illustrated by waveform 96, and a resistor 97 provides a current waveform 98. The designation OV of FIG. 4 represents a zero voltage level; and the designation OMA of FIG. 4 represents a zero current level. A summing amplifier 100 adds the outputs of both the buffers 33 and 34 as represented at the output of resistors 93 and 95, respectively, to twice the output of the halfwave rectifiers 85 and 86 through the resistors 92 and 97. It is to be noted that the resistors connected directly to the output of the buffers 33 and 34 are twice the value of the resistors at the output of the rectifiers 85 and 86. The waveform at the summing junction of the resistors 92, 93, 95, and 97 are represented at 101 of FIG. 4 and constitute the algebraic summation of such waveforms. The waveform 102 is a DC signal representing the net results of the input from the buffers 33 and 34. The output of the summing amplifier 100, of course, is zero when the actuator is in the middle of its stroke. Since the waveform 102 is shown to be slightly negative, the actuator 12 is above its half-way point. A filter network including capacitor 103 and resistor 104 in the feedback path of the summing amplifier 100 smooths the waveform. Thus, if the actuator 12 were in a position such that the valve were fully closed, the waveform 102 would represent a positive value, and if it were fully open, the waveform 102 would be a negative value. The range of the signal depends on the size and stroke of the particular LVDT being used. It is normalized to 10V after a gain stage 105. Therefore, an inverting bias and the gain amplifier 105 together with a variable resistor 106 and 107 shift the signal so that it has a range of from 0 to positive 10 volts. The resistor 106 biases the signal so that at the full positive potential at the output 102 of the summing amplifier 100, a position signal representative of 0 volts occurs at output 108. The variable resistor 107 is adjustable so that the maximum voltage at the output 108 is 10 volts. These adjustments are required so that the system may be used with various types of LVDT's and actuators that have various (strokes). The final position signal at the output 108 is represented by a waveform 109 of FIG. 4. As shown in FIG. 1, the position signal 109 at the output 108 of the demodulator circuit 30 is directed through the output buffer 33 for any desired system utilization. Also, the output signal is connected to the jumper connection 64 so that it can be used in the control circuit, and it is the input to a position characterizer 37, as described in connection with FIG. 6.

Figure 5:
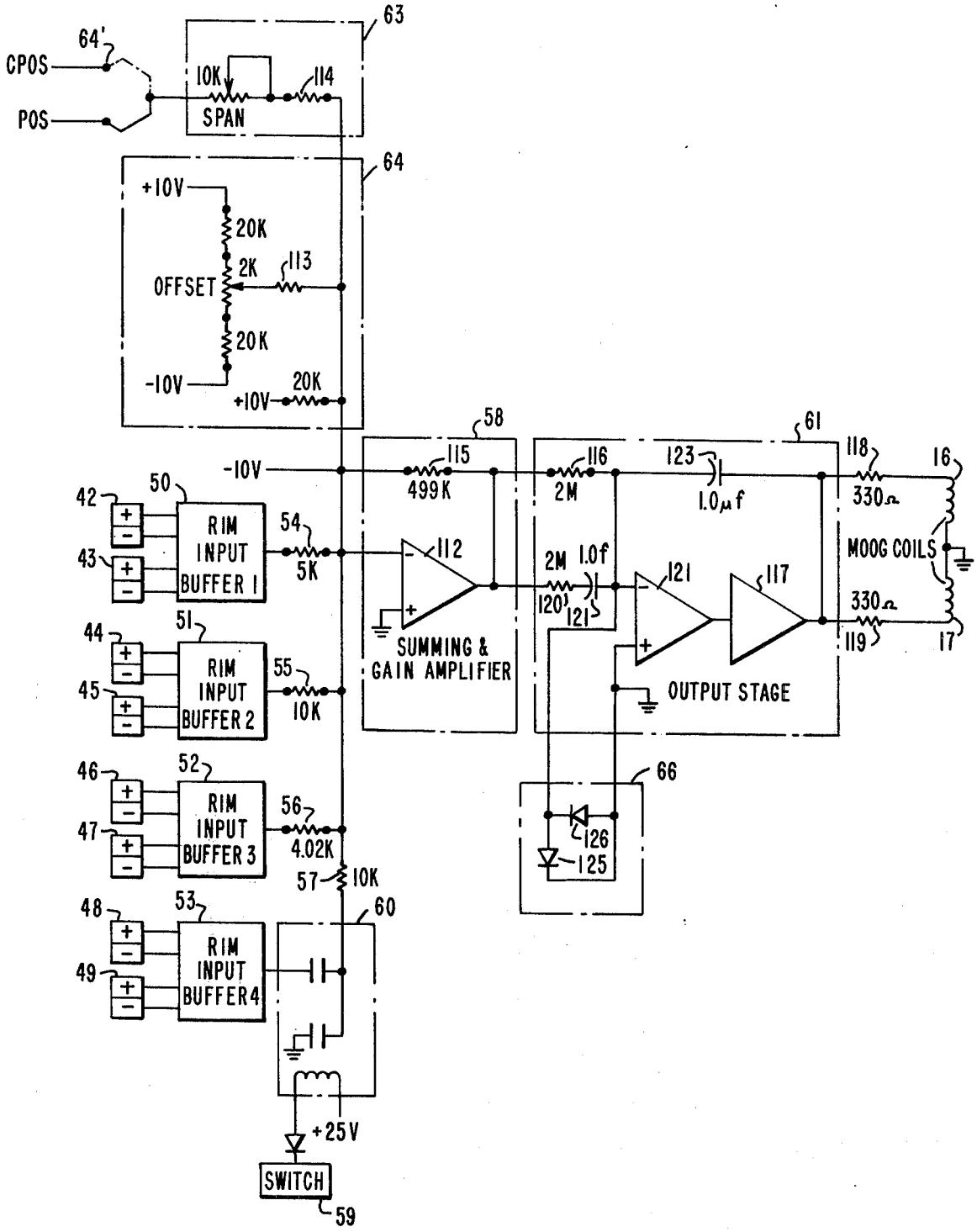
FIG. 5 shows in more detail schematically the input portion and the proportional plus integral controller portion of FIG. 1.

Referring to FIG. 5, the details of the proportional plus integral controller circuitry 61, the offset circuitry 67, and the arrangement for accepting the input to the controller. Generally, each of the four input buffers 50,

51, 52, and 53 accept a differential input signal by way of terminals 42, 44, 46, and 48, respectively. The input terminals 43, 45, 47, and 49 may be either spare input terminals or utilized to override the valve control signal on the previously mentioned inputs. The input signal on terminal 48 or 49 to the input buffer 53 may be introduced to the controller 61 selectively by virtue of the relay 60 controlled by a switch signal 59. This input may be utilized for a test signal on the valves when required.

Thus, each of the four input buffers 50 through 53 accepts two differential input signals and computes their sum reference to signal common. This sum is represented in FIG. 5 as a current at .111. The gain of each differential input is one half so that the sum of the two 10 volt input signals from 42, 43 and 44, 45 and 46, 47 and 48, 49, respectively, can be represented with a 10 volt signal at the output of the buffers 50 through 53, respectively. The output of each buffer 50 through 53 goes to a summing and gain amplifier 112 through normalizing plug-in resistors 54 through 57, respectively. As previously mentioned, the resistors 54 through 57 normalize the output signal from its respective buffer; and the sum of these normalized or weighted signals at the output of each of the resistors 54 through 56 is summed together with a bias signal at the output of 57 (if connected) and the offset signal at the output of a resistor 113. The offset signal is provided to normalize to whatever base the system is working (0 to 10 volts). The summing and gain amplifier 112 provides the means for producing an error signal at its output 114 which is obtained by subtracting the feedback signal at the output of the normalizing resistor 63 from the sum of the input signals at the outputs of the normalizing resistors 54 through 57 and 113. This error signal is multiplied by a particular gain set by a resistor 115. The summing and gain amplifier 112 drives the proportional plus integral amplifier 61 with a gain of one, and a time constant that is adjusted by a resistor 116. The proportional plus integral amplifier 61 includes a current booster amplifier 117 which provides the output current to drive the MOOG valve coils 16 and 17 of the servo valve 15. The coils 16 and 17 are driven in parallel through separate output resistors 118 and 119 so the valve will continue to work should one of the lines be shorted or broken.

More specifically, the amplifier 112 determines the proportionality gain by the resistor 115 in its feedback loop. The amplifier 112 is connected at its output through a resistor 120 and a capacitor 121 to the input of amplifier 122 of the controller 61. A capacitor 123 is connected across the output of the current booster amplifier 117 and the input of the amplifier 122. The amplifiers 112 and 122 are connected in cascade arrangement because of the low impedance output of the amplifier 112. This low impedance permits an independent gain or proportionality adjustment by way of the valve of resistor 115 and a time constant adjustment by way of the valve of resistor 116. The manner of connecting the two stages 112 and 122 permits the reset time or time constant and the proportionality gain to be independently changed. With only one stage, a change in the proportionality gain would also be accompanied by a variation in the reset time. Thus, as previously mentioned, an increase in the proportionality gain increases the chances of overshooting the valve position; and such overshooting increases the reset times for the signal and consequently the valves to take an inordinate length of time to reach its steady state value. The combination of the resistor 116 and the capacitor 123 determines the reset time. The combination of the resistor and capacitors 121 provides a flowpath filter circuit. The capacitor 123 is to be actually multiplied by the resistor 116 to get the reset time. Thus, it can be seen that the adjustment of the resistors 115 and 116 which provide the proportionality and reset time adjustments respectively are independent; and the adjustment of one does not affect the operation of the other. Thus, the gain amplifier and the time constant amplifier, which are both commercially available precision operation amplifiers are connected in cascade arrangement with independent adjustment for proportionality gain and time constants of the proportional plus integral controller 61.

The minus input and the plus input of the amplifier 122 which provides the reset time for the controller 61 includes a back-to-back connection of diodes 125 and 126 which constitutes an anti-saturation device 66. The diodes 125 and 126 clamp the plus input and the minus input together by approximately six-tenths of a volt. Thus, the plus and the minus inputs cannot deviate in value by more than the six-tenths of a volt. Without the inclusion of the diodes 125 and 126, the capacitor 123 would be charged by current obtained from the operational amplifier 112 through resistor 116 and would continue to charge up completely to the point of the output voltage of amplifier 112. Thus, assuming that the output voltage of amplifier 112 was 13 volts, for example, the difference between the minus input and the plus input of amplifier 122 would be approximately 13 volts when the capacitor 123 were charged completely. Thus, the output of the amplifier 117 is saturated because of the completely charged condition of the capacitor 123 which prevents the amplifier 122 from being in control. With the arrangement of the diodes 125 and 126, the capacitor 123 can never charge above a voltage producing more than six-tenths of a volt across amplifier 122 input, because above six-tenths of a volt the charging current all passes through the diodes to ground. With a maximum charge on the capacitor limited to a value producing six-tenths of a volt at the input of amplifier 122, the operational amplifier 122 very quickly responds to any change in the error signal. Such time constants are very significant in the system of the present invention, particularly in an application where it is desirous of closing a valve in 150 milliseconds, for example.

With respect to the operation of the controller 61, the object is to get the best possible response of the valve to the system and still remain stable within a predetermined phase lag to prevent oscillation. The limitation on such operation may be termed "the convergence error", which is for a proportionality gain system only. The converging error would be that error required to hold the valve at a steady state position. This is necessary because there is a finite gain at the output of the proportional portion of the controller. With respect to the integral portion 122 of the controller, there is an infinite or extremely high DC gain; and the time that it takes the error at the output of the controller to get to zero is termed "following error". Thus, in effect, instead of having our following error depend upon our converging error, it is possible in accordance with the embodiment of FIG. 5 to increase or decrease our proportionality or convergence error without affecting our following error and vice versa.

Figure 6:
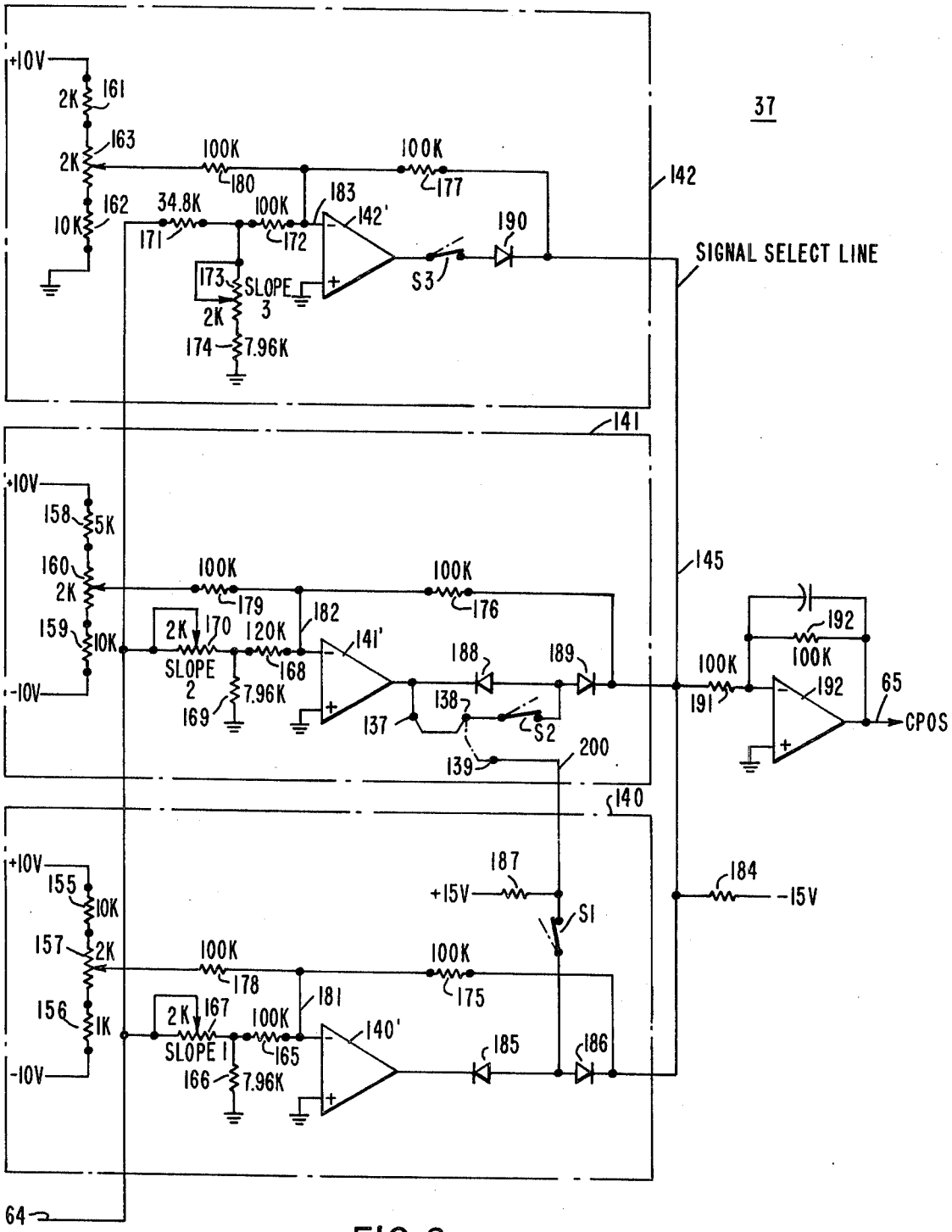
FIG. 6 is a schematic block diagram of the position characterizer of the system of FIG. 1 according to one embodiment of the invention.

As previously mentioned, the feedback signal from the LVDT at the output of the normalizing resistor 63 (FIG. 5) may be a linear feedback signal or a nonlinear characterization, depending upon the position of the jumper connection 64. With reference to FIG. 6, the characterizer 37 (FIG. 1) operates as a three-slope function generator. The characterizer can be so connected to select a characterization where each closed loop actuator position versus card input slope is steeper than the previous slope; or, the characterizer can be so connected that the second slope of a series is less steep than either of the others. This is advantageous in connection with its utilization for different types of valves.

Referring to FIG. 6, the position characterizer 37, which acts on the LVDT position signal at the output of the position demodulator circuit 30 (FIG. 1) to produce a characterized position signal at output 65, includes in the present embodiment of the invention three distinct stages for producing three independently characterized slopes. The characterized signal at the output 65 is connected through the jumper connection 64 as the feedback signal to the controller 61. The circuit includes internal jumper terminals 137, 138, and 139. When the jumper terminal 137 is connected to the terminal 138, the position characterizer operates such that each closed loop actuator position versus card input slope is steeper than the previous one. When the jumper terminal 139 is connected to the jumper terminal 138, the position characterizer permits the second or intermediate slope to be shallower than either of the others. The circuit 37 includes an amplifier stage for each slope of the characterizer. An amplifier stage within the dashed lines referred to as 140 controls the initial slope of the characterized curve, the stage within the dashed lines 141 controls the intermediate or second slope of the curve, and the stage within the dashed lines 142 controls the final slope of the curve. The cooperation of each of the stages 140, 141 and 142 in producing the characterized output signal at 65 and the function of the components therein will be described in connection with a typical operation of the system for a given characterization.

Figure 7:
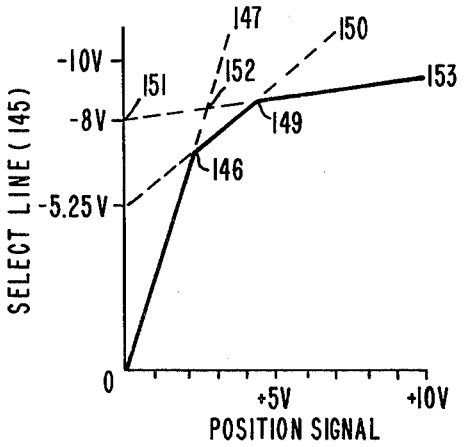
FIG. 7 is a graphical illustration showing a typical three slope function in accordance with one described connection of the characterizer of FIG. 6.

Prior to discussing the operation of the circuit 37, reference is made to FIG. 7 which graphically represents the output signal on signal select line 145 of FIG. 6 in response to a position input signal at 64 for a characterization in accordance with the connection of the jumpers 137 and 138 as shown in FIG. 6. It is to be noted, that each segment of the curve has a slope which is less steep than the previous one, which may be termed as a curve with monotonically decreasing slopes. The abscissa of the curve represents an input voltage at 64 that may vary between 0 and +10 volts. The ordinate of the curve represents a negative voltage at the signal select line 145 which may vary between 0 and −10 volts. Line segments 0-146-147 represent the gain or slope of the stage 140 (FIG. 6). Line segment 148-146-149-150 represents the slope or gain of stage 141 (FIG. 6); and slope 151-149-153 represents the slope or gain of the stage 142 of FIG. 6. As will be pointed out in detail in connection with the operation of the circuit 37, the amplifier stage 140 provides the output signal represented by the line segment 0-146. When the input signal reaches 146, the amplifier stage 140 is no longer effective to control the signal on line 145; and the amplifier stage 141 controls the signal represented by the line segment 146-149. When the position input signal at line 64 reaches the voltage at 149, the amplifier stage 142 controls the signal on 145 in accordance with the line segment 149-153.

While the stage 140 is producing the signal on line 145, as represented by 0-146, that portion of the line segment represented by dashed lines 148-146 from the amplifier stage 141, and the dashed line segment 151-149 of the amplifier stage 142 is prevented from controlling the value of the signal on the line 145. Similarly, when the amplifier stage 141 is producing the output along line 146-149, the amplifier stage 140 output 146-147 and the amplifier stage 142 output represented by line 151-149 is prevented from producing the signal on the signal select line 145. Also, when the amplifier stage 142 is generating its previously mentioned signal represented by the line segment 149-153, the amplifier stage 141 output represented by line 149-150 and the amplifier stage 140 output represented by the line 146-147 is blocked. Thus, it is seen that the circuit 37 operates as a low select circuit with respect to the individual stages 140, 141, and 142 (i.e., the stage producing the lesser total value, which total value represents the product of the input voltage (64) and gain plus the break point voltage). Such total value is the least for stage 140 until the input voltage on 64 reaches the 146 in the example of FIG. 7. The total value is less for stage 141 when the input value is between 146 and 149 on the graph; and such total value is less for stage 142 from the 149 to the maximum input voltage at 64. The break point value for each of the stages 140, 141, and 142 is established at an input voltage of zero. Thus, for the stage 140, the break point voltage is zero, for stage 141, in he example of FIG. 7 at 148 is assumed to be −5.25 volts, and the break point value for stage 142 in the example at 151 is assumed to be −8 volts.

With reference to FIG. 6, the break point voltage for stage 140 is determined by a voltage divider circuit connected across a positive and negative 10 volt potential that includes plug-in resistors 155 and 156 and a variable resistor 157. Similarly, the break point voltage for stage 141 is determined by the circuit that includes plug-in resistors 158 and 159 and variable resistor 160 connected across a positive and negative 10 volt potential. Also, the break point voltage value for the stage 142 is determined by the resistance network that includes plug-in resistors 161 and 162 and variable resistor 163 connected across a positive 10 volt potential and ground. The plug-in resistors are the coarse adjustment and the front edge potentiometer resistance is the fine adjustment. Some typical values for various break points for the individual stages are listed as follows:

SELECTING BK. PT. FOR STAGES 140 and 141

| DESIRED BREAKPOINT V | | | (155, 158) | (156, 159) |
|---|---|---|---|---|
| 8.2V | – | 10.0V | JUMPER | 20K |
| 7.4 | – | 9.1 | 1K | 20K |
| 5.8 | – | 7.8 | 2K | 15K |
| 4.9 | – | 6.2 | 5K | 20K |
| 3.7 | – | 5.4 | 5K | 15K |
| 2.5 | – | 3.7 | 10K | 20K |
| 1.2 | – | 2.5 | 10K | 15K |
| (−)1.6 | – | 1.6 | 5K | 5K |
| (−)0.09 | – | 0.9 | 10K | 10K |

| SELECTING BK. PT. FOR STAGE 142 DESIRED BREAKPOINT V | | | 161 | 163 |
|---|---|---|---|---|
| 8.2V | – | 10.0V | JUMPER | 10K |
| 7.0 | – | 8.4 | 2K | 10K |
| 5.5 | – | 7.6 | 2K | 5K |
| 4.1 | – | 5.7 | 5K | 5K |
| 2.2 | – | 4.3 | 5K | 2K |
| 1.4 | – | 2.7 | 10K | 2K |
| 0.0 | – | 1.6 | 10K | JUMPER |

The slope or gain of each one of the stages 140, 141, and 142 is adjusted by means of a front edge potentiometer and two plug-in resistors for each slope. For stage 140, the gain is determined by the value of a plug-in resistor 165, a resistor 166, and a potentiometer 167. The gain for stage 141 is determined by the value of a plug-in resistor 168, resistor 169, and potentiometer 170. The gain for the stage 142 is governed by plug-in resistors 171 and 172, potentiometer 173, and resistor 174. The following Table provides some typical examples of various values of the resistor 165, 168, and 171 and 172 for various gain of respective segments.

| SELECTING SLOPE FOR STAGE 140, 141 GAIN (175–176 = 100K) | | | | (165,168) |
|---|---|---|---|---|
| 1.0 | – | 6.9 | 1/.10 – 1/.14) | 10.0K |
| 8.2 | – | 5.9 | (1/.12 – 1/.17) | 12.1K |
| 6.6 | – | 4.9 | (1/.15 – 1/.20) | 15.0K |
| 5.0 | – | 3.7 | (1/.20 – 1/.27) | 20.0K |
| 4.0 | – | 3.1 | (1/.25 – 1/.32) | 24.9K |
| 3.3 | – | 2.6 | (1/.30 – 1/.38) | 30.1K |
| 2.8 | – | 2.2 | (1/.35 – 1/.46) | 34.8K |
| 2.5 | – | 1.9 | (1/.40 – 1/.52) | 40.2K |
| 2.2 | – | 1.7 | (1/.45 – 1/.59) | 45.3K |
| 2.0 | – | 1.6 | (1/.50 – 1/.63) | 50.0K |
| 1.6 | – | 1.3 | (1/.63 – 1/.77) | 61.9K |
| 1.3 | – | 1.1 | (1/.77 – 1/.91) | 75.0K |
| 1.2 | – | .95 | (1/.83 – 1/1.1) | 82.5K |
| 1.0 | – | .79 | (1 – 1/1.2) | 100K |
| .82 | – | .66 | (1/1.3 – 1/1.5) | 120K |
| .66 | – | .53 | (1/1.5 – 1/1.9) | 150K |
| .56 | – | .45 | (1/1.8 – 1/2.2) | 178K |
| .50 | – | .40 | (1/2.0 – 1/2.5) | 200K |
| .40 | – | .32 | (1/2.5 – 1/3.1) | 249K |
| .33 | – | .27 | (1/3.0 – 1/3.7) | 301K |
| .27 | – | .22 | (1/3.7 – 1/4.5) | 365K |
| .23 | – | .19 | (1/4.4 – 1/5.2) | 432K |

| SELECTING SLOPE FOR STAGE 142 GAIN | | 172 | 171 |
|---|---|---|---|
| .21 – .19 | (1/4.8 – 1/5.7) | 100K | 34.8K |
| .18 – .16 | (1/5.4 – 1/6.4) | 100K | 40.2K |
| .17 – .14 | (1/6.0 – 1/7.1) | 100K | 45.3K |
| .15 – .13 | (1/6.5 – 1/7.7) | 100K | 50.0K |
| .13 – .11 | (1/7.8 – 1/9.3) | 100K | 61.9K |
| .11 – .09 | (1/9.3 – 1/11) | 100K | 75.0K |
| .10 – .08 | (1/10 – 1/12) | 200K | 30.1K |
| .09 – .07 | (1/12 – 1/14) | 200K | 34.8K |
| .08 – .06 | (1/13 – 1/16) | 200K | 40.2K |
| .07 – .06 | (1/15 – 1/17) | 200K | 45.3K |
| .06 – .05 | (1/16 – 1/19) | 200K | 50.0K |
| .05 – .04 | (1/19 – 1/23) | 200K | 61.9K |
| .05 – .04 | (1/22 – 1/27) | 200K | 75.0K |
| .04 – .03 | (1/25 – 1/30) | 499K | 40.2K |
| .04 – .03 | (1/28 – 1/34) | 499K | 45.3K |
| .03 – .03 | (1/31 – 1/37) | 499K | 50.0K |
| .03 – .02 | (1/37 – 1/44) | 499K | 61.9K |
| .02 – .02 | (1/43 – 1/53) | 499K | 75.0K |
| .02 – .02 | (1/47 – 1/57) | 499K | 82.0K |
| .02 – .01 | (1/56 – 1/68 ) | 499K | 100K |
| .02 – .01 | (1/67 – 1/81) | 499K | 120K |

-continued

| SELECTING SLOPE FOR STAGE 142 GAIN | | 172 | 171 |
|---|---|---|---|
| .01 – .01 | (1/81 – 1/100) | 499K | 150K |

Each one of the stages includes a feedback resistor 175, 176, and 177, respectively, which determines the overall gain of each stage in conjunction with the slope adjustment resistors previously mentioned. In accordance with the present embodiment, the resistors 175 and 176 may be greater than 100K ohms for higher gain but must not be less than the 100K ohms as illustrated. Each one of the stages 140, 141, and 142 include a resistor 178, 179 and 180 into which the previously described breakpoint adjustment circuit feeds. The current feeding the negative input to each one of the amplifiers on lines 181, 182, and 183, respectively, is the algebraic sum of the current from the dividing circuit for adjusting the voltage breakpoint and the appropriate resistor 178 through 180, respectively, and the current produced by the incoming signal at input 64 through the resistors for adjusting the slope of the particular line segment as previously described, and a feedback current from line 145 through resistors 175, 176, 177, respectively. The signal select line 145 is connected to a resistor 184 to a negative supply voltage of 15 volts in the present embodiment. At the output of amplifier 140' of the stage 140, is a pair of diodes 185 and 186 which are commonly connected at their anode terminals and through a resistor 187 to a positive 15 volt source. At the output of amplifier 141' of the stage 141 is a pair of diodes 188 and 189 that are connected commonly at their anode terminals and to the previously mentioned jumper terminal 138. In the present example, it is recalled that the jumper terminals 138 and 137 are connected while the jumper terminals 138 and 139 are disconnected. At the output of amplifier 142' of the stage 142, a diode 190 is connected with its cathode terminal connected to the line 145 and the feedback circuit which includes the resistor 177. Similarly, cathode connection of the diode 189 is connected to the feedback circuit that includes the resistor 176, and the cathode terminal of the diode 186 is connected to the feedback circuit that includes the resistor 175.

Assuming that the breakpoint adjustment and the gain adjustment of each of the stages 140, 141, and 142 have been made such that the stage 140 has a breakpoint of zero volts, the breakpoint of voltage of stage 141 is −5.25 volts, and the breakpoint voltage of stage 142 is −8 volts. Also, assume that the gain of each of the stages corresponds to the corresponding line segment previously described in connection with FIG. 7 as follows. Assuming that the line segment from the stage 140 has a gain of 2.5, i.e., 1 volt at the terminal 64 produces a negative 2.5 volts on the signal select line 145; that the slope of the stage 141 is 0.75, i.e. for every 4.0 volts at the input 64, −3 volts is produced on the line 145; and that the gain of the stage 142 is 0.2, i.e. for every 5.0 volts at the input 64, −1.0 volts is produced on the line 145.

In response to an input voltage of 2 volts, for example, a current is produced through the resistor 165 connected to the input terminal or line 181 of the amplifier 140'. Also, no current is flowing through the resistor 178; therefore, all of the current through the line which includes the resistor 165 is flowing through the resistor 175 in the feedback circuit, and the amplifier 140' is acting to produce a voltage at the signal select line to maintain the current flow through the resistor 175. At this point, the 2 volt input is producing a −5 volts on the signal select line 145. The resistor 184 is a bias resistor which permits current to flow in the system.

Under these conditions of 2 volt input, stage 2 would ordinarily provide an output of −6.75 volts measured at the signal select line which value is computed by multiplying the input voltage (2) by the gain (0.75) and adding the breakpoint voltage of −5.25. However, since the voltage is −5 volts on the line 145, the diode 189 prevents the amplifier 141' from affecting the output signal by blocking the current that would have to flow into the output of amplifier 141' in order for it to lower the voltage on line 145 from −5.0 to −6.75 volts.

Also, the stage 142 is not conducting under the conditions of a 2 volt input because with a breakpoint of −8 volts and a slope of two-tenths, the amplifier 142 would ordinarily produce −8.4 volts on the signal select line 145 except for the blocking action of the diode 190. The diode 190 blocks the output of the amplifier 142 because current would have to flow from line 145 into the output of amplifier 142' in order for it to lower the voltage on line 145 from −5.0 volts to −8.4 volts.

Thus, when stage 1 is producing −5 volts on the signal select line 145, stages 141 and 142 are not conducting because they are prevented from sinking current because of the diodes 189 and 190, respectively. Because the voltage on line 145 is not as negative as stage 141 would ordinarily provide, there is insufficient current flow in the feedback path of stage 141 through resistor 176. Thus, the amplifier 141' attempts to lower the voltage and sink more current which the diode 189 prevents. The amplifier 140' at this time is controlling signal select line 145 because there is enough current provided through the resistor 187 to maintain the −5 volts on the signal select line 145. This satisfies the requirements to keep amplifier 140' in balance because the same amount of current is flowing out of input node 181 through feedback resistor 175 as is flowing in through resistor 165. The stage 140 controls how much current is provided through resistor 187 sinking current through diode 185. The amplifier 141' attempts to sink more current to keep the input 182 in balance, but the diode 189 prevents the sinking of such current, and there the output of the amplifier 141' goes as far negative as possible which prevents the diode 189 from conducting. Similarly, the amplifier 142' is prevented by diode 190 from sinking current to keep the negative input at 183 in balance; therefore, the output of 142' goes as far negative as possible which prevents the diode 190 from conducting.

Assuming that the input signal on 64 increases to 4 volts, for example, which with a gain of −2.5 volts and a breakpoint of 0 volts would cause the output of the amplifier 140' to put out −10 volts on the signal select line. Also, with respect to the amplifier 142', which has a breakpoint of −8 volts and a gain of two-tenths, the output on the signal select line would ordinarily be −8.8 volts. However, the slope for the stage 141 is 0.75 with a breakpoint of −5.25 volts resulting in an output of −8.25 volts on the signal select line. Since the most positive slope is the −8.25 volts because both the stages 142 and 140 are more negative, as previously mentioned, both the diodes 190 and 186 are in the blocking state which results in the signal on 145 being controlled solely by the stage 141. At this point, the reason that the diodes 190 and 186 of stages 142 and 141, respectively, are in a blocking state is because the voltage on signal select line 145 is more positive than is necessary to balance stage 140 or 142 by producing 0 volts at points 181 and 183 respectively. The voltage at both these points is therefore positive which causes each amplifier (140' and 142') to produce an output as negative as possible since 181 and 183 are connected to the inverting or negative inputs of these amplifiers. The large negative outputs of the amplifiers cause diodes 186 and 190 to be reverse biased which is the blocking state.

Assume that the signal on input 64 increases to 6 volts, the stage 140 in accordance with the previous calculations would ordinarily produce a −15 volts on the signal select line; and the stage 141 would ordinarily produce a −9.75 volts on the signal select line 145, while stage 3 has an output that would be −9.2 volts. Thus, for the same reasons as given in connection with the previous input of 2 and 4 volts, respectively, the diodes 186 and 189 are placed in their blocking states.

Figure 8:
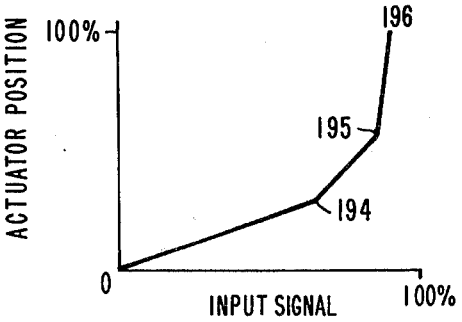
FIG. 8 is a graphical illustration of the valve actuator position versus the system input behavior with the system connected for a characterized position feedback.

The signal select line 145 is connected through a resistor 191 to an amplifier 192 which has a feedback resistor 193 connected between its input and output to invert the polarity on the signal select line to provide an output slope representing the characterized position at 65 that is of the same polarity as the position signal input at 64. FIG. 8 illustrates the behavior of the system of FIG. 1 with its position characterizer 37 adjusted as described above and jumber 64' connecting line 64 to feedback normalizing resistor 63. With reference to FIG. 8, line segments referred to as 0-194 correspond to the line segment of FIG. 7 referred to as 0-146 and is produced by the stage 140 of FIG. 6. The line segments referred to as 194-195 correspond to the line segment 146-149 of FIG. 7 and is produced by stage 141 of the circuit 37 of FIG. 6. The line segment 195-196 corresponds to the line segment 149-153 of FIG. 7 and is produced by the stage 142 of the characterizer circuit 37 of FIG. 6. Thus, it is seen that the input on the abscissa of FIG. 8 corresponds to the input signal from the turbine control system that would be connected for example to signal pair 44 in FIG. 1 that varies between 0 and +10 volts; and the ordinate of FIG. 8 corresponds to the actual position of the LVDT (FIG. 1) for a corresponding input signal.

Figure 9:
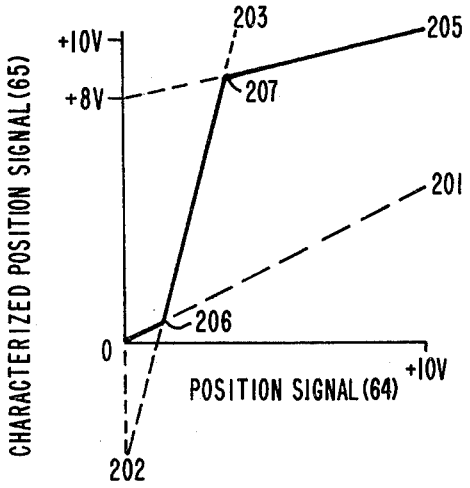
FIG. 9 is a graphical illustration showing a typical three slope function generated in accordance with a second described connection of the characterizer.

As previously mentioned, the characterizer is also capable of producing a curve made up of three line segments, the first and last of which have a lesser gain than the intermediate segment. Thus, the characterizer 37 may operate as shown by the curve of FIG. 9 by connecting the jumper terminals (FIG. 6) 138 and 139 and disconnecting the jumper terminals 137 and 138. With this type of connection, a second signal select line 200 is provided between the jumper terminal 139 which is connected to the common anode connection between the diodes 188 and 189 and the common anode connection of the diodes 185 and 186. The signal select line 200 selects the more negative of the signals from the stages 140 and 141, while the signal select line 145 compares the signal on the line 200 with the output of the stage 142 and selects the more positive of such signals, which signal is the governing segment. Thus, with reference to FIG. 9, slope 0-201 represents the output of the amplifier 140', line 202-203 represents the output of amplifier 141', and line 204-205 represents the output of amplifier 142'. The stage 140 controls the characterized position at output 65 until the signal reaches point 206 of the line referred to at 0-206, at which time the output of stage 141 becomes more negative which causes the characterized output signal to be controlled along that segment referred to at 206-207. At point 207, the signal select line 145 assumes control and selects the more positive signal which is that line segment referred to as 207-205 of FIG. 9. Similar to the arrangement with respect to the first described jumper connection, the unity gain inverting amplifier 192 inverts the signal to produce an output 65 of the same polarity as input 64.

Figure 10:
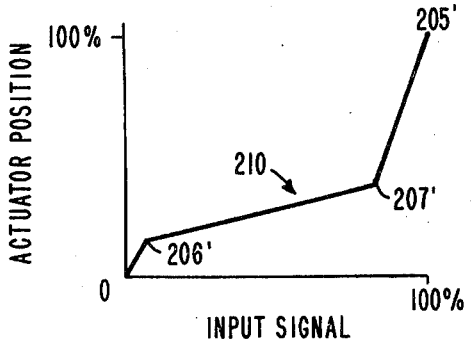
FIG. 10 is a graphical illustration of the actuator position versus the signal input with the position charcterizer connected as graphically illustrated in FIG. 9.

FIG. 10 illustrates the behavior of the system of FIG. 1 with its position characterizer 37 adjusted as described above and jumber 64' connecting line 64 to the feedback normalizing resistor 63. More specifically, with respect to the operation of the characterizer 37 (FIG. 6) connected to generate the characterization of FIG. 9, assume that the position signal is 1 volt, for example. In connection with this description of operation, it is also assumed that the resistor 165 in stage 140 is changed to a value of 178K.

In response to the one volt input at 64, the output of the amplifier 140' with a gain of one-half and a breakpoint of zero provides for a negative one-half volts appearing on the line 145 from the output of the amplifier 140' through the diodes 185 and 186. Since the breakpoint of 140' is zero, the amplifier 140' is in balance. For the amplifier 141', where resistors 158 and 168 = 20K and the resistor 159 = 5K with a gain of 4 and a breakpoint of plus 6 volts, a positive 2 volts is appearing at the output of amplifier 141'. The signal select line 200 which connects a positive supply voltage (15 volts) through the resistor 187 to the common anode connection of the diodes 185 and 186, and also to the common anode connection between the diodes 188 and 189 through the jumpers 138 and 139 biases the line in a positive direction and permits either the amplifier 140' or 141' to drive the line more negative. Thus, the particular amplifier 140' or 141' that requires the line 200 to be least positive in order for the particular amplifier to balance is the one that conducts its output to the signal select line 145 for controlling the position of the valve. Since the negative one-half volt drives the line 200 more negative than the plus 2 volts of the amplifier 141' at an input voltage of plus one volt, the amplifier 141' is driven in a positive direction and its output is blocked by the diode 188. By balancing the amplifier is meant that the voltage across the input terminals must be zero. When an input voltage is developed across the input terminals designated (minus) and (plus) of each amplifier, the output of such amplifier is the voltage across its input multiplied by gain which is very high. With respect to the stage 142, which has a two-tenths gain and a breakpoint voltage of minus 8, which renders the output of the amplifier to be minus 8 volts less the input voltage of 1 volt times the gain of two-tenths of a volt, would produce a total of minus 8.2 volts at its output if it weren't connected as shown in FIG. 6. However, inasmuch as the line 145 is receiving a negative one-half volt, such negative output is insufficient to balance the amplifier 142', causing the amplifier to go positive, which produces a negative output from 142' which is blocked by the diode 190.

Thus, with a one volt input, 142' is all the way negative and blocked by the diode 190; amplifier 141' is all the way positive and blocked by the diode 188; while the amplifier 140' because of its breakpoint of zero volts and a gain of five-tenths is supplying line 145 and consequently the amplifier 192 to produce the characterized signal at 65 which corresponds to the appropriate point along the line segments 0-206 as shown in FIG. 9.

Assuming that the input signal is increased to 3 volts, for example, the output of amplifier 141' with a gain of 4 and a breakpoint of minus 6 volts would amount to a negative 6 volts at its output; and the amplifier 140' which has a gain of five-tenths and a breakpoint of zero would produce an output of minus 1½ volts; and the output of the amplifier 142' with a gain of two-tenths and a breakpoint of minus 8 volts would be −8.6 volts, except for the connecting arrangement as shown in FIG. 6.

Under these circumstances, diode 188 is conducting because the cathode of 188 is more negative than its anode; and the common anode connection, which is biased by the fifteen volt supply voltage which is connected through the resistor 187 and the jumper connections 138 and 139 is approximately −5.4 volts. Also, the amplifier 140' is blocked because the negative six volts generated by the amplifier 141' on line 145 is more negative than the negative 1½ volts now required to keep the amplifier 140' in balance. This results in a negative voltage on the minus input of the amplifier 140' which causes 140' to go positive. This has no effect on the −5.4 voltage on the line 200 because of the blocking action of the diode 185. Thus, because the common anode connection between diodes 188 and 189 is more negative than the connection between 185 and 186 would otherwise be the amplifier 141' is balanced and controls the signal on the line 145 for generating the characterized valve position signal at 65. With respect to the amplifier 142', the balancing voltage on line 145 must be at least −8.6 volts. This requirement is more negative than the minus 6 volts generated by the amplifier 141', which causes a positive voltage on the minus input of the amplifier 142', which drives the amplifier negative thus causing the diode 190 to block its output.

Thus, for a voltage input of three volts the amplifier 140' is positive, 142' is negative, and 141' is controlling until the input on voltage 64 either increases to balance the amplifier 142' or decreases to balance the amplifier 140'.

Assume that the input voltage at 64 is increased to 6 volts, for example. The point at which the amplifier 142' is connected to the line 145 becomes a −9.2 volts. This is calculated as previously described by adding the minus eight volts breakpoint plus the negative 1.2 voltage gain which totals a negative 9.2 volts. With reference to the amplifier 140', the 6 volt input with a gain of five-tenths renders the point connected to the signal select line 145 at minus three volts. With respect to the amplifier 141', the 6 volt input with a gain of 4 and a minus 6 volt breakpoint would produce an output of minus eighteen volts. With reference to the signal select line 200 which would be approximately −17.4 volts at the common anode connection of the diodes 188 and 189, and the common anode connection between the diodes 185 and 186 at the output of the amplifier 140' would be a negative 2.4 volts. However, as previously described, the most negative point is selected at the line 200 which is the negative 17.4 volts. Actually, the amplifier 141' will only go negative in actual practice to about fourteen volts. As a result, we have the amplifier 141' and the amplifier 142' attempting to put out a negative 14 plus volts and a negative 9.2 volts, respectively. The signal select line 145 is selecting the most positive voltage, which is −9.2 volts at the output of the amplifier 142' to control the signal into the amplifier 192 and the resulting position signal at 65. Line 145 is not as negative in this example as is necessary to keep amplifier 141' in balance, i.e., it is insufficiently negative such that there is a small positive voltage appearing at the negative input terminal of the amplifier 141' which drives the amplifier all the way negative. With respect to the amplifier 140', since the signal select line one is a negative 9.2 volts which is more negative than needed by this stage to balance the amplifier 140', a negative voltage is appearing at the negative input terminal of amplifier 140' which causes the output to go positive. The effect of the positive condition of the amplifier 140' is blocked by the diode 185. With respect to the amplifier 141', although the negative output of about minus 14 volts is on the signal select line 200 any effect from that onto the signal select line 145 is blocked by the diodes 186 and 189 of the stages 140 and 141, respectively. The two diodes 186 and 189 are in effect parallel connected because the signal select line 200 connects their anodes together and the signal select line 145 connects their cathodes together.

With reference to FIG. 6, switches referred to as S1, S2 and S3 are normally closed during the operation of the characterizer; and are used to isolate the other stages when the breakpoint and slope of one stage is adjusted after the resistors have been selected for breakpoint and slope as previously described. It should be recalled that the breakpoint adjustments for each slope set the value of that slope when the input signal at 64 is zero. Briefly, in adjusting the characterizer for a typical set of breakpoints and gains, such as shown in FIGS. 7 and 8, the switches S2 and S3 are opened for adjusting the line segments of the stage 140 initially.

The potentiometer 157 is set for a zero percent actuator position with a zero volt input plus a bias to insure that the valve is fully closed at zero input. The potentiometer 167 is set for a 30 percent actuator position with a 7.5 volt input. Then, after opening switch S1 and closing switch S2, the potentiometer 160 is set for a zero percent actuator position with a 5¼ volt input and the potentiometer 170 is set for a 50 percent actuator position with a 9 volt input. Then, after opening the switch S2 and closing S3, the potentiometer 161 is set for a zero percent actuator position with an 8 volt input; and the slope potentiometer 173 is set for a 100 percent actuator position with a 10 volt input. The actuator should be checked for a 50 percent position with an input of 9 volts.

In adjusting the characterizer for a slope having an inflection discontinuity; that is, where the intermediate slope has less gain than its contiguous slopes as shown in FIGS. 9 and 10, the jumper connections 64 are made as previously described; and the procedure is the same as above described, except that after the potentiometer 170 for slope 2 is adjusted for the proper gain with the breakpoint potentiometer 160 disconnected and switch S2 closed, connect potentiometer 160, close S1, and adjust 160 for the proper breakpoint 206 (FIG. 9), the open switches S1 and S2 and close switch 53 to adjust slope 3.

What we claim is:

1. A system for controlling the position of an electrohydraulically operated valve, comprising A. a valve;

B. means including a valve actuator operative to position the valve in accordance with the value of an electrical valve position signal;

C. means operative to generate an electrical feedack signal having a characteristic corresponding to the position of the valve;

D. a proportional plus integral controller operative to generate at its output the valve position signal in accordance with the value at its input of the valve control signal and the feedback signal;

E. means to apply an electrical valve control signal to the controller;

F. said feedback signal generating means including (a) a linear variable differential transformer having a primary winding and at least two secondary windings, said primary and secondary windings being inductively coupled relative to each other in accordance with the position of the valve, (b) means to generate an oscillating voltage in the primary winding, (c) a pair of differential buffers, each electrically connected across a respective one of the secondary windings, (d) means including a positive half wave rectifier electrically connected to one of the buffers to rectify the current in one of the secondary windings, (e) means including a negative half wave rectifier electrically connected across the other buffer to rectify the current in the other secondary winding, (f) means to sum algebraically the outputs of the buffers and the rectifiers to characterize the feedback signal in the form of a DC voltage having a level corresponding to the position of the valve;

whereby the feedback signal level is unaffected by variations in electrical ground potential to minimize inaccuracies in the feedback signal level.

2. A system according to claim 1 wherein the summing means of the feedback signal generating means includes a resistive network that sums the unrectified output from the input buffers with twice the sum of the output signal from both rectifiers.

3. A system for controlling the position of an electrohydraulically operated valve, comprising A. a valve;

B. means including a valve actuator operative to position the valve in accordance with the value of an electrical valve position signal;

C. means operative to generate an electrical feedback signal having a characteristic corresponding to the position of the valve;

D. a proportional plus integral controller operative to generate at its output the valve position signal in accordance with the value at its input of the valve control signal and the feedback signal;

E. means to apply an electrical valve control signal to the controller;

F. said controller including (a) a first low output impedance amplifier, (b) a second high input impedance amplifier electrically connected at its input through a resistive capacitance network to the output of the low output impedance amplifier, (c) means including a first resistance connected electrically across the input and output of the first amplifier to adjust the gain of the first amplifier independent of the time constant of the second amplifier, (d) means including a second resistance connected across the resistance capacitance network to adjust the time constant independent of the gain of the first amplifier;

G. whereby the proportionality and time constant of the controller may be adjusted independently without the value of one affecting the value of the other.

4. A system according to claim 3 wherein the second amplifier further includes a pair of parallel connected diodes in back to back relationship across its inputs, thereby preventing at times response lag due to a fully charged feedback capacitor when the controller output saturates.

5. A system for controlling the position of an electro-hydraulically operated valve, comprising A. a valve;

B. means including a valve actuator operative to position the valve in accordance with the value of an electrical valve position signal;

C. means operative to generate an electrical feedback signal having a characteristic corresponding to the position of the valve;

D. a proportional plus integral controller operative to generate at its output the valve position signal in accordance with the value of the valve control signal and the feedback signal at its input;

E. means to apply an electrical valve control signal to the controller;

F. a function generator to characterize, according to a predetermined curve of a plurality of linear slopes, one of the signals at the controller input to vary the valve position as a non-linear function of said one signal, said generator including (a) an operational amplifier for each linear slope of the curve, (b) first circuit means to apply the signal to be characterized to each amplifier input, (c) second circuit means electrically connecting the input and output of each amplifier to balance its respective amplifier in response to a selected minimum voltage applied to the first circuit means, (d) third circuit means electrically connecting the outputs of each amplifier to select the signal from the output of one of said amplifiers in accordance with its magnitude, (b) means to apply the selected signal to the controller input, whereby each slope of the selected curve is independent of the value of the other.

6. A system according to claim 5 wherein the first circuit means of the function generator includes means to adjust the gain of each amplifier independently of the other.

7. A system according to claim 6 wherein the third circuit means of the function generator includes means to select the output signal of greatest magnitude of one polarity.

8. A system according to claim 6 wherein the function generator includes at least three operational amplifiers, and the third circuit means includes means to select the output signal of greatest magnitude of one polarity for the first and second amplifier and the output signal of least magnitude for the third amplifier.

9. A system according to claim 5 wherein the signal to be characterized is the generated feedback signal.

10. A system for controlling the position of an electro-hydraulically operated valve, comprising A. a valve;

B. means including a valve actuator operative to position the valve in accordance with the value of an electrical valve position signal;

C. means operative to generate an electrical feedback signal having a characteristic corresponding to the position of the valve;

D. a proportional plus integral controller operative to generate at its output the valve position signal in accordance with the value of the valve control signal and the feedback signal at its input;

E. means to apply an electrical valve control signal to the controller;

F. said means to apply the electrical valve control signal includes a plurality of input terminal pairs, each pair being connectable to said signal, an input buffer having its input connected across each pair of input terminals, and a summing device connected in common to each buffer output to average the signals at the buffer output.

* * * * *